US005135333A

United States Patent [19]

Guntert, Sr. et al.

[11] Patent Number: 5,135,333

[45] Date of Patent: Aug. 4, 1992

[54] BAND REINFORCEMENT INSERTING APPARATUS AND PROCESS

[75] Inventors: Ronald M. Guntert, Sr.; Ronald M. Guntert, Jr., both of Stockton; Wilbur F. Earley, Modesto, all of Calif.

[73] Assignee: Guntert & Zimmerman Const. Div. Inc., Ripon, Calif.

[21] Appl. No.: 638,942

[22] Filed: Jan. 9, 1991

[51] Int. Cl.[5] ..... E01C 11/16; E01C 23/04

[52] U.S. Cl. ..... 404/100; 404/88

[58] Field of Search ..... 404/72, 75, 83, 86, 404/88, 100, 101, 102

[56] References Cited

U.S. PATENT DOCUMENTS

| | | | |
|---|---|---|---|
| 3,331,296 | 7/1967 | Perkins et al. | 404/100 |
| 3,421,419 | 1/1969 | Adcock | 404/100 |
| 4,433,936 | 2/1984 | Moser | 404/100 X |
| 4,636,110 | 1/1987 | Augouard | 404/100 |
| 4,799,820 | 1/1989 | Laeuppi et al. | 404/100 |

FOREIGN PATENT DOCUMENTS

| | | | |
|---|---|---|---|
| 3117544 | 11/1982 | Fed. Rep. of Germany | 404/100 |

*Primary Examiner*—Ramon S. Britts
*Assistant Examiner*—Nancy Connolly
*Attorney, Agent, or Firm*—Townsend and Townsend

[57] ABSTRACT

An apparatus and process for the placement of horizontally disposed side by side and/or vertically staggered reinforcing bands in combination with a typical slip form or form type concrete paver. The paver receives and spreads fresh concrete, continuously dispences reinforcing bands, then levels, holds, liquifies and finishes the concrete in a single pass. A plurality of inserters which dispense the bands are lined across the width of the apparatus and may be staggered inserters to enhance concrete flow around them. They are threaded with the reinforcement and move through unconsolidated concrete positioned between the leveler and the form.

28 Claims, 7 Drawing Sheets

NOTE
REAR INSERTER SHOWN VERTICALLY OFFSET FOR CLARITY
REAR INSERTER
FRONT INSERTER
DIRECTION OF TRAVEL

BAND REINFORCEMENT INSERTING APPARATUS AND PROCESS

BACKGROUND OF THE INVENTION

This invention relates to placement of flat steel or other flat reinforcement in concrete and specifically to materials continuously longitudinally laid in side-by-side relation along concrete pavement.

SUMMARY OF THE PRIOR ART

Continuous steel bands placed in concrete pavement for reinforcement are known. These continuous steel bands are varying in width and thickness. By way of example, the bands can be about 1⅝ inches in width, and in the order of ⅛ of an inch thick. The bands are dispensed typically from cassettes containing rolls of spirally wound galvanized steel band reinforcing. Typically, the surfaces of the bands are provided with an uneven surface (usually dimples). This uneven surface enables the band to key to the concrete in a manner not at all unlike the uneven surface of standard reinforcing bar.

Such bands are wound from an initial linear disposition in spiral rolls. The rolls are wound to a radius that does not bend the reinforcing band beyond its elastic limit. Thus when the bands are unwound, they return to the original linear disposition.

The bands are placed within longitudinally extending concrete slabs in roadway or runway pavement. The bands are disposed with their major surfaces within the plane of the slab. The bands extend lengthwise of the slab in the longitudinal direction in the direction of the roadway or runway that they are reinforcing. Typically, such bands are on centers of 4 inches.

In the prior art, it has been common to first dispose the bands in tubes on various centers in the path of the paving apparatus. By way of example, a typical center-to-center spacing can be in the order of 4 inches. Concrete is placed over and around the previously placed bands. Once this is done, the slab is conventionally placed over the bands and finished overlying the bands.

Such horizontally disposed reinforcing bands have been used in combination with pavers of the slip form variety. Typically, the bands have been dispensed in front of and extended in tubes under the path of an oncoming spreading, vibrating, consolidating, and confining slip form paver. Such dispensing occurs from a separate dispensing machine carrying cassettes having rolls of the spirally wound tape. Tape is serially dispensed from each of the rolls to form a plurality of side-by-side reinforcing strips in the path of the paver.

The slip form paver follows the tape dispensing apparatus. The slip form paver is typically a unitary machine controlled to line and grade mounted on a single frame that assimilates the fresh concrete (placed ahead and roughly spread on the grade by trucks and other means) and that has a series of attachments for causing the freshly placed concrete to be consolidated and formed into a finished pavement slab. A typical slip form paver may include spreading apparatus, which spreader apparatus takes masses of concrete and evenly distributes the concrete in the path of a paver. Thereafter, a rough leveling metering gate is passed over the previously placed and spread concrete. This leveling metering gate effects an approximate uniform head to the vibrating surge hopper metering concrete to the finished slab. Behind the slip form, but generally unrelated to this process there are, typically, finishing devices that finish the surface of the concrete. (In its simplest form, the machine may not have some of the above mentioned attachments )

The reader will understand that the above description is only a general summary of such pavers. It should be apparent that such a paver may be of the form variety as distinguished from the slip form variety. Further, such a paver may contain other attachments that need not be mentioned here.

In the prior art, the cassette carrier and bands have occupied all or a portion of the interval in front of the machine over the ground on which the concrete is to be placed. Because the apparatus for placing the bands and the bands themselves occupy the intended path of the machine, the area in front of the paver is not available for the direct placement of concrete. For example, there is no way a truck containing a load of fresh concrete from a batch plant can back up in the whole width to the whole front of the paver to deposit a load of concrete to be processed by slip form paver.

Consequently, in such prior art apparatus conveying of the concrete to the paver occurs by first side loading the concrete to a conveyor apparatus. This transverse and parallel conveyor apparatus is located to the side of the intended path of the paver (generally on an adjacent lane that must be placed later) The concrete is then gathered to a first conveyor, thereafter passed to a series of conveyers, and finally deposited centrally to the paving machine spreader and spread. Such deposit occurs directly on and over previously horizontally placed reinforcing bands disposed in tubes. Thereafter, leveling, slip form paving and, finally, finishing conventionally occurs from apparatus carried on the slip form paver.

Machines for laying plastic strips to induce cracking of weakened plane contraction joints in concrete paving such as that paving forming the lining of highways and canals are known. Specifically, such plastic strips are given a vertical alignment with respect to the slab in which they are deposited. These strips are typically deposited within a groove formed in the slab to define weakened plane contraction joints. These strips are widely spaced; there is no problem associated with close side-by-side spacing of the strips. See our previous U.S. Pat. No. 3,098,413 entitled "Concrete Laying Machine With Grooving Mechanism" issued Jul. 21, 1963.

STATEMENT OF THE PROBLEM

In the prior art, in conjunction with the paver, multiple machines have been required. Specifically, receiving and transferring conveyors for the concrete followed by a machine for the dispensing of the continuous bands of reinforcing have been used. Thereafter, at least a paver follows.

This prior art arrangement has the further disadvantage of not permitting concrete to be placed directly on the roadway being paved in the path of the oncoming paver. Typically, dumping stations must be provided at the side of the paver. This causes restriction of the total volume of concrete that can be handled.

Additionally, precise control of the exact location of the continuous bands of reinforcement in the concrete is not possible with the prior art. The concrete is placed around and through the previously placed bands. During such placing deflection of the previously placed reinforcing bands can occur.

Finally, the embedding of the bands in the concrete has been found to be less than perfect. Specifically, aggregate and other solid materials within the concrete have trouble finding of their way around, under, and into firm engagement with the previously disposed reinforcing bands. Further, since the bands are contained within the mass of concrete of the slab, the overlying pass of the leveling apparatus, the slip form pan and the finishing apparatus has little direct effect on the embedding of the bands in the concrete slab.

The limitations of the prior art machines include many facets. Such machines lack the ability to economically feed concrete to the full width of the subgrade ahead of the paver. This failure limits the production capacity of such machines. As a result, additional equipment and personnel are required to attend to such paving operations—at least as compared to the following disclosure.

Additionally, the prior art machines have possible lamination difficulty taken the location of the flat reinforcing is on the center line of the slab. This has not enabled prior art pavers to take advantage of the so-called "beam" reinforcing capability of vertically staggered band reinforcement.

Upon reading the following specification and description, it will be appreciated that most of these limitations are overcome. Specifically, it will be appreciated that the discovery of problems can constitute invention. Consequently, insofar as these problems are not set forth and solved in the prior art, invention is claimed.

SUMMARY OF THE INVENTION

In combination with a controlled-to-line-and-grade paving machine of the slip form or form-type variety for placing concrete, an apparatus and process for the placement of horizontally disposed, continuously dispensed, side-by-side and/or vertically staggered reinforcing bands is disclosed. The paver is of the variety that sequentially receives and spreads (directly on grade ahead or from a side feeder) fresh concrete in front of the paver, levels and holds the concrete to an approximate uniform head, liquifies the concrete (by vibration as necessary), confines the concrete to finish dimension of the intended pavement slab, and finishes the slab by passing a confining form pan over the slab as placed. The apparatus for the introduction and placement of continuously disposed horizontal concrete band reinforcing is introduced in the freshly leveled concrete between the spreading and leveling apparatus and the front of the form. Preferably, the horizontal bands are dispensed into the concrete from staggered dispensing inserters located between the leveling apparatus and the form. These inserters have the band reinforcement threaded within and dispensed from band supporting tubes trailing the inserters as they move through the unconsolidated concrete. The inserters are longitudinally or longitudinally and vertically staggered to permit concrete (with contained aggregate) to flow around them. In conditions where the unconsolidated concrete is stiff, the inserters may be vibrated in passage through the unconsolidated concrete so as to liquify the otherwise semi-solid, previously spread, unconsolidated concrete and to assist free passage of the inserter through the unconsolidated concrete. Where the concrete is of a consistency to require vibration, the inserter (supplied with vibration as needed) and the slipform (supplied with vibration as needed) impart sufficient fluidity to the unconsolidated concrete to permit the continuously dispensed horizontal band reinforcing to enter and be fully immerse within the fluidized consolidating concrete. Three discrete variations are disclosed for leading the reinforcing bands to the dispensing inserter. A preferred embodiment disposes cassettes dispensing the tape to overlie the interval between the concrete leveling and the forming paver; in this embodiment, it is preferred that the same paver frame carrying the paver also carry tape dispensing cassettes and inserters. In second and third embodiments, the tape is fair led from a cassette- carrying unit independently supported and traveling in front of the paving apparatus. In the second embodiment, fair leading from the cassettes to the inserters occurs over the concrete spreading and leveling into and through the inserters. In the third embodiment, where the base is of a nature that travel on grade ahead of the paver is not possible, permitted or practical, or a form-type paver is used (and there is access at the side) a receiving conveyor may be used in conjunction with a side feeder to place concrete in front of the paver. An improved placement of the reinforcing results which can be precisely controlled in elevation with respect to the slab.

OTHER OBJECTS, FEATURES AND ADVANTAGES

An object of this invention is to disclose an improved apparatus and process for placement of concrete having continuous steel band or other band reinforcement, the concrete being placed by paving apparatus. Accordingly, an inserter passes through concrete deposited immediately in front of a moving paver. Preferably, and where the unconsolidated concrete is too stiff to permit free passage of the staggered inserters through the freshly placed concrete, the inserter may be provided with sufficient vibration for liquifying the unconsolidated concrete to permit passage of the inserters. A preferable location for the inserter is between the spreader and the front of the paver form so that the inserter passes through concrete being consolidated into the finally produced pavement slab. A continuously dispensed horizontally disposed band is threaded through the inserter and into the finally placed concrete slab.

If the inserter vibrates, the same vibration is also imparted to the band and concrete. As a result, thorough and complete embedding of the concrete around the dispensed, horizontally disposed band reinforcement occurs. Further, where the inserter vibrates, consolidation of concrete by the paver is supplemented. Assuming that the paver also requires vibration, paver vibration requirement may be reduced as it will be supplemented by the vibrating inserter.

An advantage of the dispensing apparatus and process herein is that the placement technique allows the reinforcing bands to be precisely positioned horizontally and vertically with respect to the slab. As a result, the bands can be disposed at varying elevations with respect to the finished concrete pavement. This allows staggering of the reinforcement in varying elevations to prevent lamination of the slab. At the same time, elevation of the band reinforcing can be set to precisely controlled elevations with respect to the top and bottom of the slab to impart beam strength to the formed pavement slab. An improved pavement product results.

An additional object of this invention is to set forth a preferred format of the band reinforcement dispensing apparatus in combination with a paver. According to this aspect, dispensing cassettes for continuously dispensing band reinforcing are mounted above and between the spreading and leveling apparatus of the paver. Such mounting occurs by extension of the frame which carries the paver. Rolls of the horizontal strips are dispensed downward to and through the inserters passing through the surface of the unconsolidated concrete. Release of the reinforcing band occurs in the deposited slab in the liquified (by vibrators on the paver) area adjacent to the confining form of paver.

An advantage of this aspect of the invention is that the cassette can be adapted to be carried as a unitary attachment to conventional form or slip form pavers. In one aspect, a slip form paver frame is sectionalized to expand in length, the reinforcement dispensing apparatus of this invention inserted, and the entire apparatus then forms a single unitary machine. Alternately, the apparatus of this invention can be added to existing machine frames.

An additional advantage of this preferred form of the paver is that concrete can be dumped directly in the path of the paver. Trucks carrying loads of concrete can back to the front of the paver. In such backing these trucks are not inhibited either by obstructing side receiving unit(s) or by cassette units dispensing band reinforcing bands. In short, the supply of concrete to a machine having no obstruction in the forward portion is greatly simplified and can be fed at a much higher volume.

By way of example, and in the preferred form of this invention over the prior art, equipment cost is reduced about 50%. The crew required to operate the machine is reduced to one-third of the number previously required. Production rate is increased on the order of 220%. At the same time, substantial fuel savings on the order of 50% are realized.

An additional object of this invention is to disclose a method and apparatus for laying the concrete reinforcing in relatively closely spaced center-to-center relation without interfering with passage through the unconsolidated concrete According to this aspect of the invention, alternate vibrating or nonvibrating inserters for placing alternate side-by-side bands in concrete are staggered in lead-to-lag relationship longitudinally with respect to the passing slip form paving apparatus. This staggering of inserters enables the unconsolidated concrete to freely conform around and about both the passing inserters and the ultimately dispensed side-by-side reinforcing bands. Such free conforming enables both intimate flow of the placed, vibrated and finished concrete around the bands as well as embedding and bonding of the bands to the concrete.

An additional object of this invention is to disclose band reinforcement dispensing apparatus that is not carried by the slip form paver. In this manner the weight on slipform is not materially changed and jacking system on new or on existing machines need not be modified and yet carry the inserting attachment. According to this aspect of the invention, the cassette apparatus carrying the dispensed rolls is placed in front of the paver. Two embodiments utilizing this aspect are disclosed.

In a first embodiment, a forward unit is built with clearance to pass over or spread and pass over unconsolidated concrete dumped on grade. The vertical reinforcing bands are fair led to the dispensing inserters placed between the leveling apparatus and form on the paver. The bands pass over the top of the paver and enter the inserters at the top, and pass downward through the inserters and disposed in an accurate position within the concrete slab.

In a second embodiment, where direct access to the substrate (normally referred to as "subgrade") on which paving occurs is not possible, practical or permitted, and when and where side access to the paver is available, a combination of a receiving and side feeding conveyor to the front and side of the paver is employed.

An advantage of this aspect of the invention is that the considerable weight of the dispensing cassettes and contained reinforcement is no longer required to be carried by the frame of the paver. Further, the weight of the entire apparatus for effecting the paving is distributed over two machines following the path of the roadway; it is therefore possible to pass the paver over load-sensitive surfaces, such as bridges and draining substrates (normally referred to as "subgrade") , which load-sensitive surfaces might otherwise be damaged by more weighty apparatus, and the ability to dump on grade ahead is preserved.

In all embodiments, the horizontally disposed reinforcing bands are released at precisely controlled elevations within the liquified and consolidating concrete, these elevations being imparted by the inserters which are, by their attachment to the paver, accurately controlled to line and grade.

BRIEF DESCRIPTION OF THE DRAWINGS

Our method in principal and parts is adaptable to the many different systems of paving, by form and slipform, such as the many different types of hauling units (trucks) in general and particular used to haul, dump, and spread on grade; equipment with its great variety to accommodate locations, materials, and volume fed to paver; paver's ability to spread and means to spread vary greatly to match specification and production requirements; systems of vibration of type and varying amount and intensity, fixed and traveling forms.

That which is described in these drawings is the adaption of our principals to a G&Z 4-track Slipform a product of commercial manufacture which may be obtained from the Guntert & Zimmerman Const. Div. Inc. of Rippon, Calif. The adaptation of system of band feed, longitudinal staggering, vertical staggering, vibration, inserters, location and accurate disposition are individual and composite and in principle adaptable to all types of concrete paving, form and slipform.

Referring to FIG. 1A tractor tread T is illustrated, which tractor tread constitutes the propelling mechanism for the paver A of this invention. The tractor tread T includes an arm 14 on paver outputting to controls 16 which uses reference wire 20 supported by stakes or stanchions 22 which through a hydraulic cylinder 18 controls the level of the paver A with respect to line and grade. The hydraulic cylinder 18 supports the frame F of the paver. It will be understood that there are four hydraulically operated tractor treads T, which tractor treads support the four corners of the frame F in propelling the paver A. In the preferred embodiment of FIG. 1A and 1B, a dump truck K is shown depositing concrete B into the path of the paver A. Typically, concrete B is dumped between paired tractor treads T in the path of the spreading apparatus S.

Figure 1A:
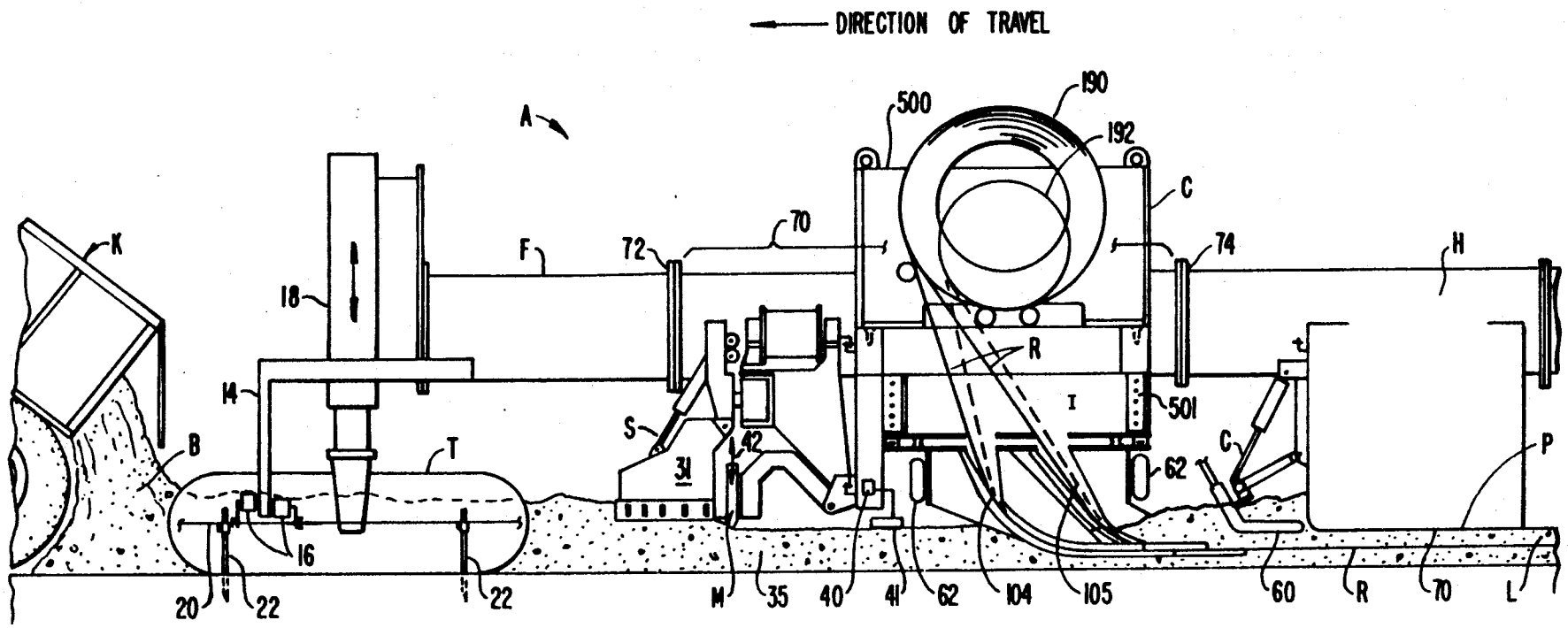
FIGS. 1A and 1B are respective side elevation and plan views in partial section illustrating the extension of the frame 70, the movement forward from front of inserter attachment of spreading and metering device S, 31, 42, M, 40, and 41 removable reinforcement cassettes with underlying inserters attached as unit to a paver—here of the slip form variety—illustrating the placement of the inserters between the leveling and concrete consolidating form.

Spreading apparatus S includes a moving open bottom bucket 31 which bucket moves and spreads unconsolidated concrete B transversely across the paver A in front of a metering device M. This bucket has the capability of spreading concrete at an even elevation in front of the metering apparatus M.

Metering apparatus M has the function of providing and controlling the confining front of a trailing surge hopper cum concrete vibrating chamber defined under and behind the metering bar M at 35 with sufficient concrete to provide an operative head on the vibrating chamber for the vibrators hung on paver and for the following finishing pan P. Typically, the metering gate M can be controlled by a float mechanism 40 with a float sensor 41. Typically, the metering gate M will be raised and lowered in the direction of arrow 42 responsive to the level of concrete set and sensed within the surge hopper 35.

Following the metering gate M there is located the cassettes C and underlying inserters I. It is the function of the cassettes C to dispense the reinforcing bands R downwardly along a threaded path through the inserters I. As the paver moves forwardly, in the direction of the arrow 60, reinforcing bands R are to start, held by an anchorage, and thereafter unreeled by friction of the concrete on the imbedded bands imbedded in the finished concrete slab L. It is, of course, the function of the inserters that constitute the novel aspect of this invention.

Continuing, a vibrator support C having a vibrators 60 immediately precedes the confining pan P. Given forward motion of the paver A in the direction of travel, pan P leaves in its wake a consolidated slab of concrete which consolidated slab may be further finished by apparatus not shown.

In the preferred embodiment of this invention, both the cassettes C and the inserters I have been added as a separate section to the disclosed apparatus, this section being denominated at 70. Addition of section 70 occurs at opposed flanges 72, 74 at either end of the section, and S, 31, 42, and M have been removed from this normally hung location on front of slipform to the location shown on FIG. 1A in front of cassette carrier and band inserter. It will thus be understood that the cassettes C and the inserters I are removable from the paver herein disclosed. Having generally discussed the overall machine, comment may be directed to specific portions.

The spreader apparatus S here shown with its transversely moving bucket 31 is known. Further, different spreader apparatuses can be used as well. For example, augers for causing movement of concrete are used. Likewise, and in some applications, dumping of concrete B from trucks K is carefully controlled. In such control, a spreader apparatus S may not be required at all.

It will be noted that, when the cassettes C and the inserters I are carried as a part of the frame F, the front part of the paver A is unoccupied. This enables truck K to proceed directly on grade and dump on grade in front of the machine.

It is to be emphasized with respect to cassette C and the dispensed reinforcing band R, that such reinforcing bands are known. Typically, they constitute dimpled galvanized steel bands. These galvanized steel bands are typically placed on close centers (in the order of 4 inches) and have with each band having a thickness of $\frac{1}{8}$ inch and an approximate of width of $1\frac{5}{8}$ inches. It will be understood by those having skill in the art that these are exemplary dimensions.

The reader will understand that in FIG. 1A, we illustrate a paver of the slip form variety. Other pavers are known. For example, this invention may be utilized with form-type pavers wherein the paver rides on rails, which rails impart both the proper elevation to and steer the paver as well as form sides of the slab.

In the preferred embodiment here shown, we illustrate vibrators 60 attached to vibrator support C. Additionally, and as will hereinafter be set forth in more detail, we include vibrators 62 attached to the inserters I. The reader should understand that such vibrators may or may not be used.

Specifically, vibrator 60 on vibrator support C can be used alone in some applications. Additionally, and where the fluidity of the freshly placed concrete permits, the inserters I can be utilized without vibrators 62. Where both vibrator 62 on the inserters I and vibrators 60 on the vibrator support C are utilized, number of vibrators and/or vibrational energy required may be reduced if and when good consolidation can be attained for 60*s*.

Likewise, a word about the function of vibration with respect to the inserters I and the vibrators 60 is in order. Vibration is utilized to supply to the paver by both the inserters I and 60*s* sufficient vibration to fluidize and consolidate the previously spread concrete. Such fluidization by I assures free passage of the inserters I and the 60*s*. This free passage is permitted by the fact that the concrete is essentially liquified and consolidated by its vibration. When the concrete enters the confining pan P, vibration dies and the bottom and sides of the pan at 70 forms the slab L to its final finished dimension.

Figures 2A, 2B, 2C, 2D, 2E, 2F, 2G, 2H, 2I, 2J, 2K, 2L, 2M, 2N, 3:
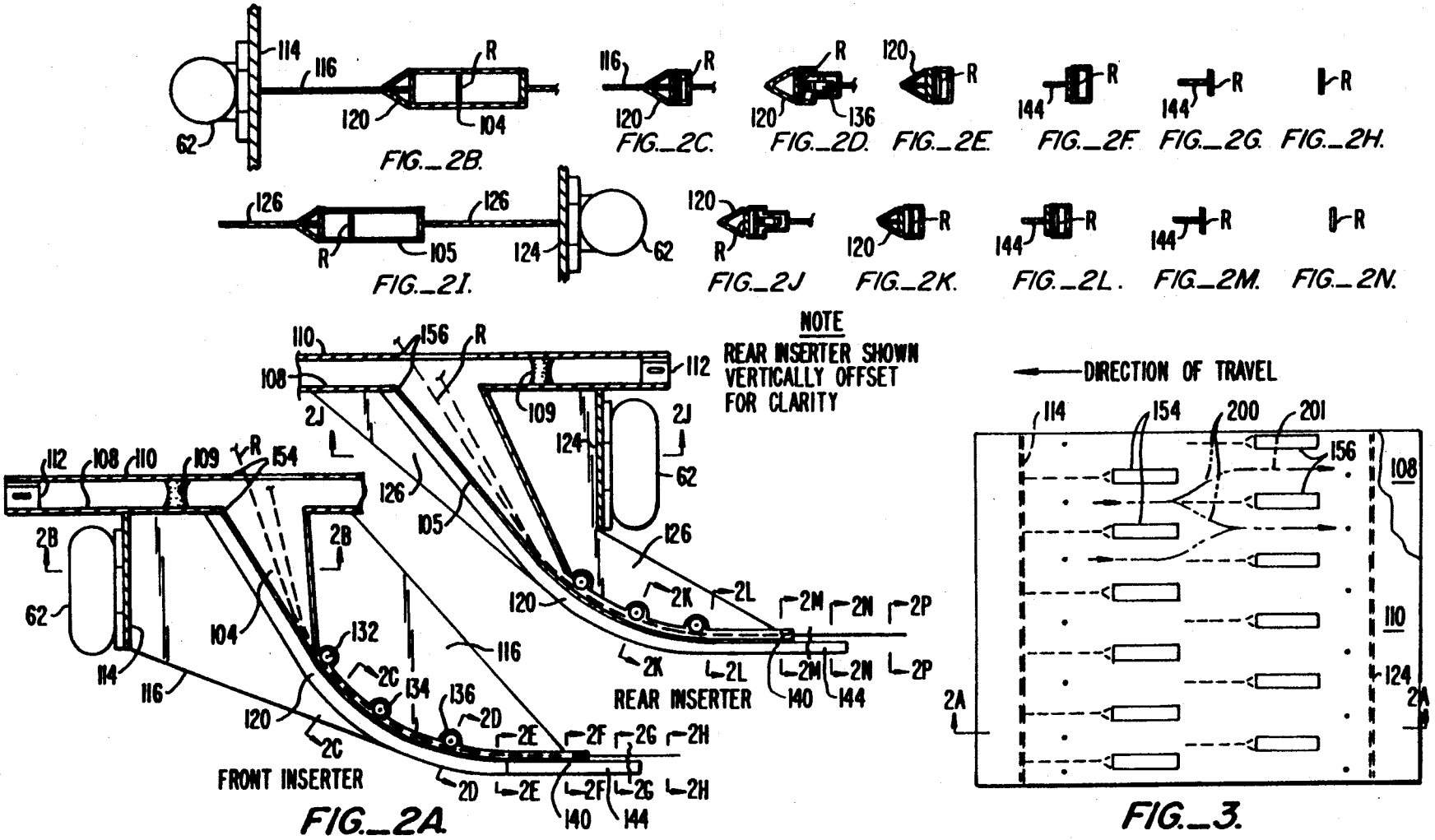
FIG. 2A is a side elevation section taken at the inserters showing the path of the tape and the relationship between two side-by-side staggered inserters.
FIGS. 2B through 2N are sections illustrating the configuration of the inserters as disposed from the cassettes to the concrete.
FIG. 3 is a plan view of the plate overlying the inserters illustrating the staggered disposition of the inserter apertures which enables disposition of the depending inserters as shown in FIG. 2A to enable concrete flow to occur around the side-by-side inserters.
Figure 4:
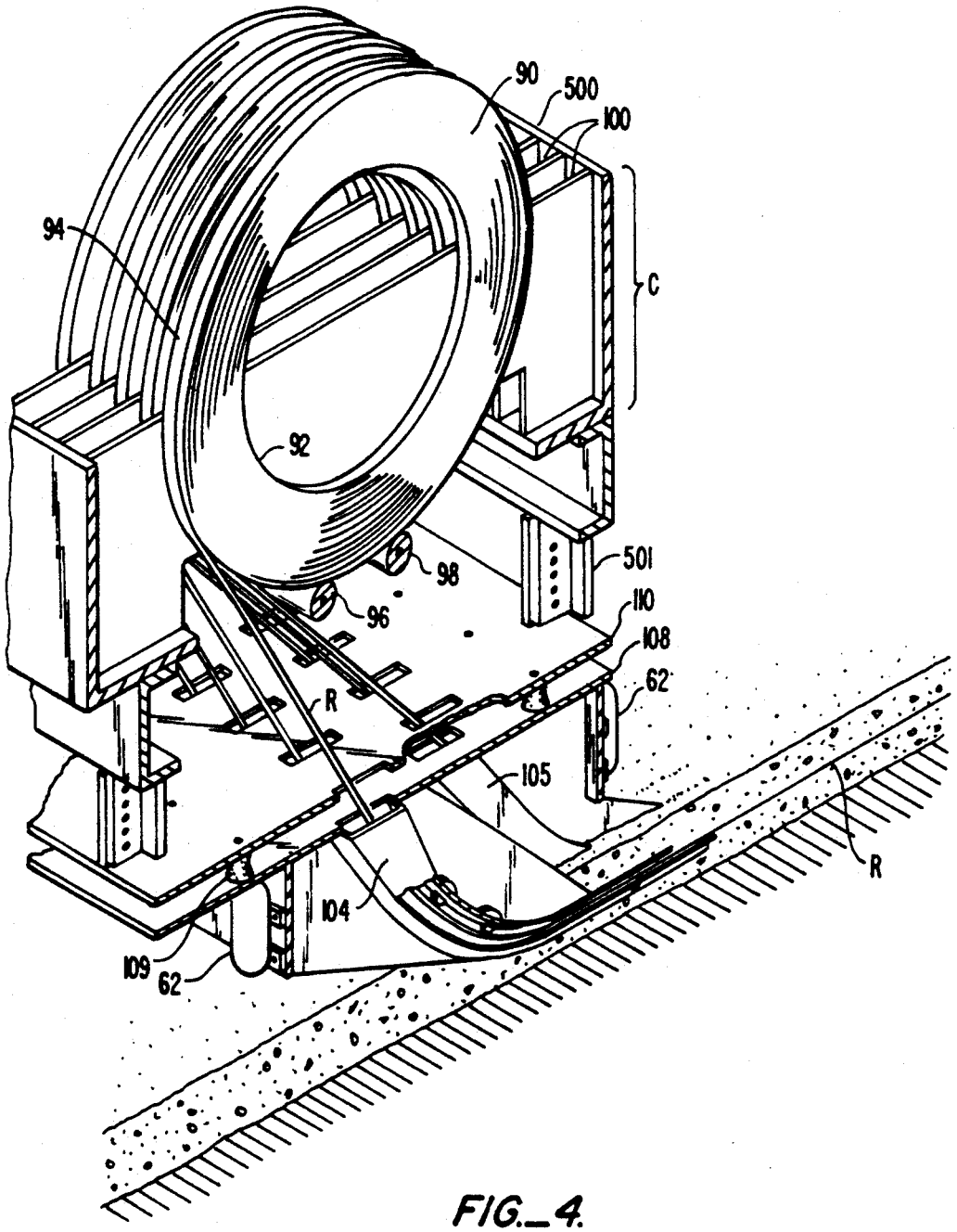
FIG. 4 is a perspective view of the inserters showing a partial view of the inserters along a fraction of the width of a concrete paver.

Having generally set forth the paver of this invention, attention can now be devoted to the construction of the cassette C and the inserters I with respect to FIGS. 2, 3 and 4.

Referring to the view and cutaway perspective of FIG. 4, dispensing of the reinforcing bands R can be understood. Specifically, the bands R are dispensed from coils 90, which coils here comprise spirally wound rolls of dimpled galvanized high tensile steel. The inner radius 92 of the coils 90 is selected so as not to stress the band beyond the elastic limit. Further, dispensing of the bands occurs in a manner wherein the relaxed disposition of the band reinforcing R is linear; there is no tendency for the band to return to the arcuate disposition 90.

Coils 90 typically rest at their outside turn 94 on rollers 96, 98. The coils are typically placed between partitions 100. These partitions are placed sufficiently close together to prevent unravelling which might otherwise occur.

It will be observed that the partitions 100 here shown are vertical. It is known in the prior art to place the partitions 100 at an angle so that the tendency of the spirally wound coil 90 to lean against the partition 100 ensures the stability of the coil 90 as the reinforcing band R is dispensed.

Notation should additionally be made that, although the band here is shown constructed of galvanized high tensile steel, other band reinforcing may be utilized as well. For example, bands of plastic suitable for reinforcing concrete could be used.

Referring to FIGS. 2A–2N, FIGS. 3 and 4, construction of the inserters here shown may be illustrated. Inserters I include forward inserters 104 and rear inserters 105. These respective inserters depend from a lower plate 108. Lower plate 108 is mounted at vibrating isolators 109 to an upper plate 110.

Figure 1B:
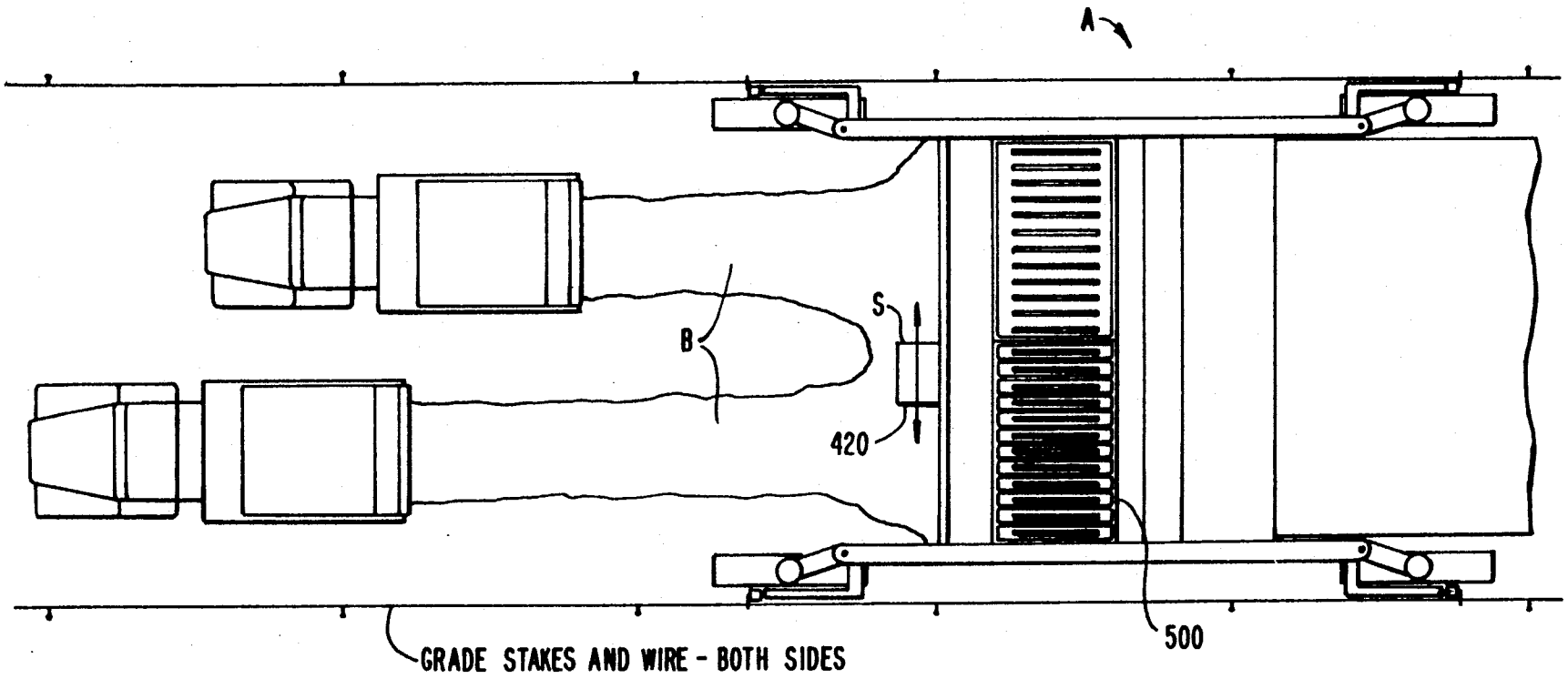

The lower and upper plates are additionally connected at preventers 112. It is the function of the preventers 112 to prevent machine movement of the paver A in the direction of travel (see FIG. 1) shearing the vibration isolators 109. Such shearing movement can occur when the respective vibrators 62 are not operating and the paver A undergoes movement with the inserters immersed in concrete.

Depending from the lower plate 108 is a leading transverse alternate inserter tie plate 114. Plate 114 has attached thereto plates 116, which plates form to the leading edge of inserter 104. The trailing edge of 104 includes such plate as support, terminating at 2F.

Additionally, a plate 124 is fastened to the trailing portion of lower plate 108. Plate 124 includes a plate 126 which plate 126 fastens to the trailing edge of trailing inserter 105. It will be understood that the forward portion of inserter 105 has such plate.

Fastened at the forward portion of beam 114 and at the rearward portion of beam 124, there are respective vibrators 62. These respective vibrators operate synchronously to effect vibration of the inserter assemblies when required.

The inserter assemblies are given the shape which enables their passage through concrete. This shape can be best understood with respect to the details of FIGS. 2B–2H; specifically, the leading edge of inserter 104 is provided with an arcuate V-shaped section 120. Section 120 continues from sections 2B through sections 2E of FIG. 2A.

As the reinforcement R passes downwardly through the arcuate shaped inserters 104, wheels 132, 134 and 136 are utilized if and as required to assist free passage of the reinforcing bands R.

Some attention can be given to the details of FIGS. 2F, 2G and 2H. Specifically, at 2F, and 2L a backflow plug 140 is utilized. Plug 140 permits the band R to pass outwardly while preventing fluidized concrete from counterflowing the threaded path of the band and inundating the interior of the inserter I.

At 2G, it can be seen that a support member 144 underlies the reinforcing R. This underlying support 144 supports the band at a precise elevation as it is finally released into the slab.

Finally, the band R alone and by itself is deposited in the wake of the inserter.

Having discussed the construction of the inserter now, attention can be directed to the side-by-side spacing of the inserters. Such spacing can be best understood by considering the configuration of the upper plate 110.

Referring to plate 110, respective forward apertures 154 are illustrated. It is through these apertures 154 that tape is threaded to the leading inserters 104 formed to plate 108 underlying the upper plate 110.

Likewise, rear inserters 105 are sped through respective apertures 156.

In the apparatus here illustrated, it is desired that the inserters include a 4-inch center-to-center spacing. Consequently, the apertures 154 are located on 8-inch centers. Apertures 156 are likewise located on 8-inch centers; these respective apertures 156 are medially placed with respect to apertures 154.

It will be appreciated that the coils 90 dispensed from the cassette C are spirally wound. As these coils are dispensed, they will diminish from a large diameter 190 (see FIG. 1) to a small diameter 192. During such dispensing, the lead of the bands R will change as illustrated in FIG. 1. To accommodate this, the respective throats of the inserters are provided with a wide opening so that the lead to the first roller 132 can change as the spirally wound reinforcement roll 90 also changes.

Additionally, it will be appreciated that the angle from which the reinforcing band R is threaded changes with respect to whether reinforcing band R is being fed to a leading inserter 104 or a trailing inserter 105. Accordingly, the angle of the inserter is likewise varied to allow convenient threading from the side-by-side coils 90 of band reinforcement R.

Having set forth the leading and lagging construction of the inserters, the specific reason for such lead and lag may now be discussed.

It will be observed that the bands herein are described as being placed on 4-inch centers. It can therefore be appreciated that the individual inserters in side-by-side spacing are closely spaced, this spacing being on the order of 2 inches. If the respective inserters I are placed in side-by-side alignment, it would be expected that aggregate within the concrete B would become wedged between the respective inserters.

By expanding the distance between the respective inserters, the tendency for the concrete aggregate to become entangled with the inserters is eliminated. Specifically, by having the forward inserters 104 on 8-inch centers and the trailing inserters 105 on 8-inch centers, clogging of the aggregate in the concrete B between the inserters will not occur. It is for this reason that we impart the disclosed stagger.

The flow path followed by the concrete B can best be understood in the path illustrated with respect to plate 110. Specifically, concrete B will flow on either side of a leading inserter 104 at paths 200. On the trailing side of the inserters 104 and as inserters 105 pass, the concrete will be diverted to paths 201. It can be seen that both paths 200 and 201 are on widely spaced 8-inch centers. Presuming that the inserters are passing through fluidized concrete, passage may easily occur.

In the preferred embodiment of our invention illustrated in FIG. 1A, it will be observed that the cassette C has been added to the frame F of the paver A. This is the most advantageous arrangement, as the paver operates as a unitary apparatus. It does, however, have the disadvantage that the considerable weight of the cassette C and its contained spirally wound rolls 90 are added to the not inconsiderable weight of the paver. Accordingly, it may be desirable not to alter paver to accommodate the added weight but to independently support the weight of the cassettes C with respect to the paver.

Figure 5:
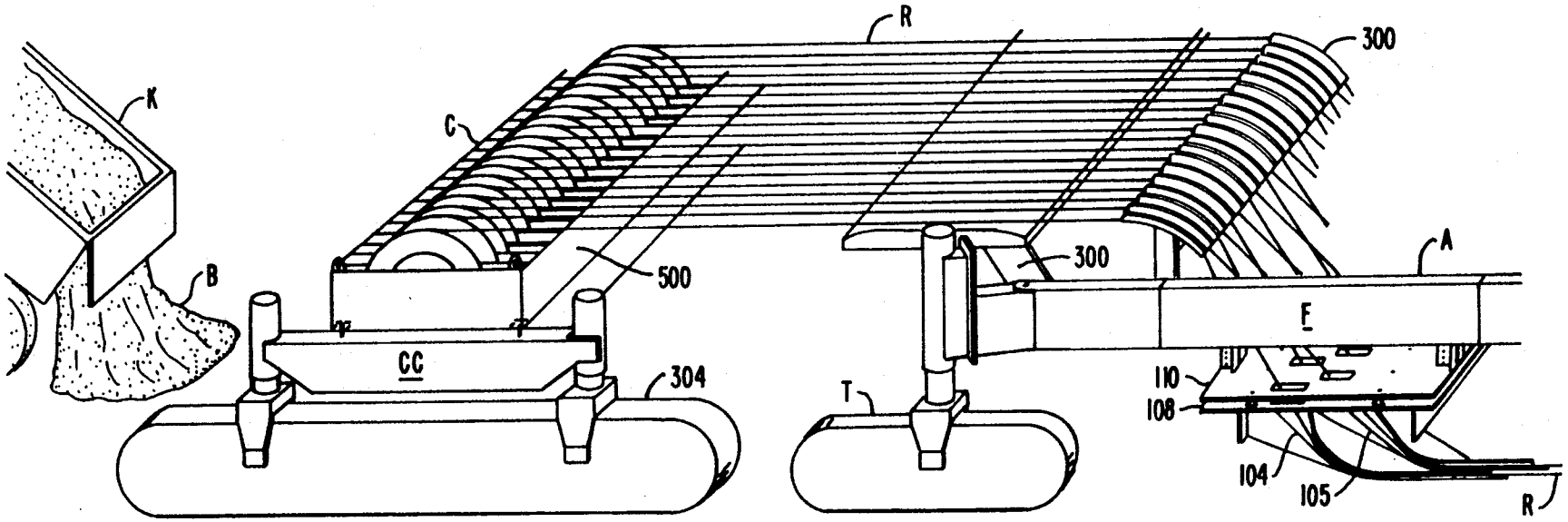
FIG. 5 is a diagram of the inserters of this invention utilized in conjunction with a paver having the cassette units travel in front of the paver with the reinforcement bands fair led over the leveling apparatus of the machine to inserters between the spreading and leveling apparatus (not shown) and form.

Such an apparatus is illustrated in FIG. 5. Referring to FIG. 5, a paver A is shown propelled by motorized tracks T. Frame F is present, which frame F has attached thereto fairleads 300 to a self-propelled cassette carrier unit cc on which cassettes C' are mounted above at a controllable elevation clear of unconsolidated concrete in the approximate track of the propelling tractor treads T of the paver, with or without spreading device(s).

Cassette C' dispenses the band reinforcing R by fair leading the bands R over respective fairleads 300 to forward inserters 104 and rearward inserter 105.

Operation is easy to understand. Typically, a dump truck K deposits concrete B in the path of the 1, 2, 3, or 4 lanes wide paver A as before. Tracks 304 straddle the deposited concrete while at the same time elevating the cassette C' well above the freshly placed unconsolidated concrete. The respective fairleads 300 effect steering of the band R in advance of the paver A. Reinforcing bands R are fair led to the respective inserters 104, 105. Paving proceeds as exactly as illustrated with respect to FIG. 1.

Figure 6:
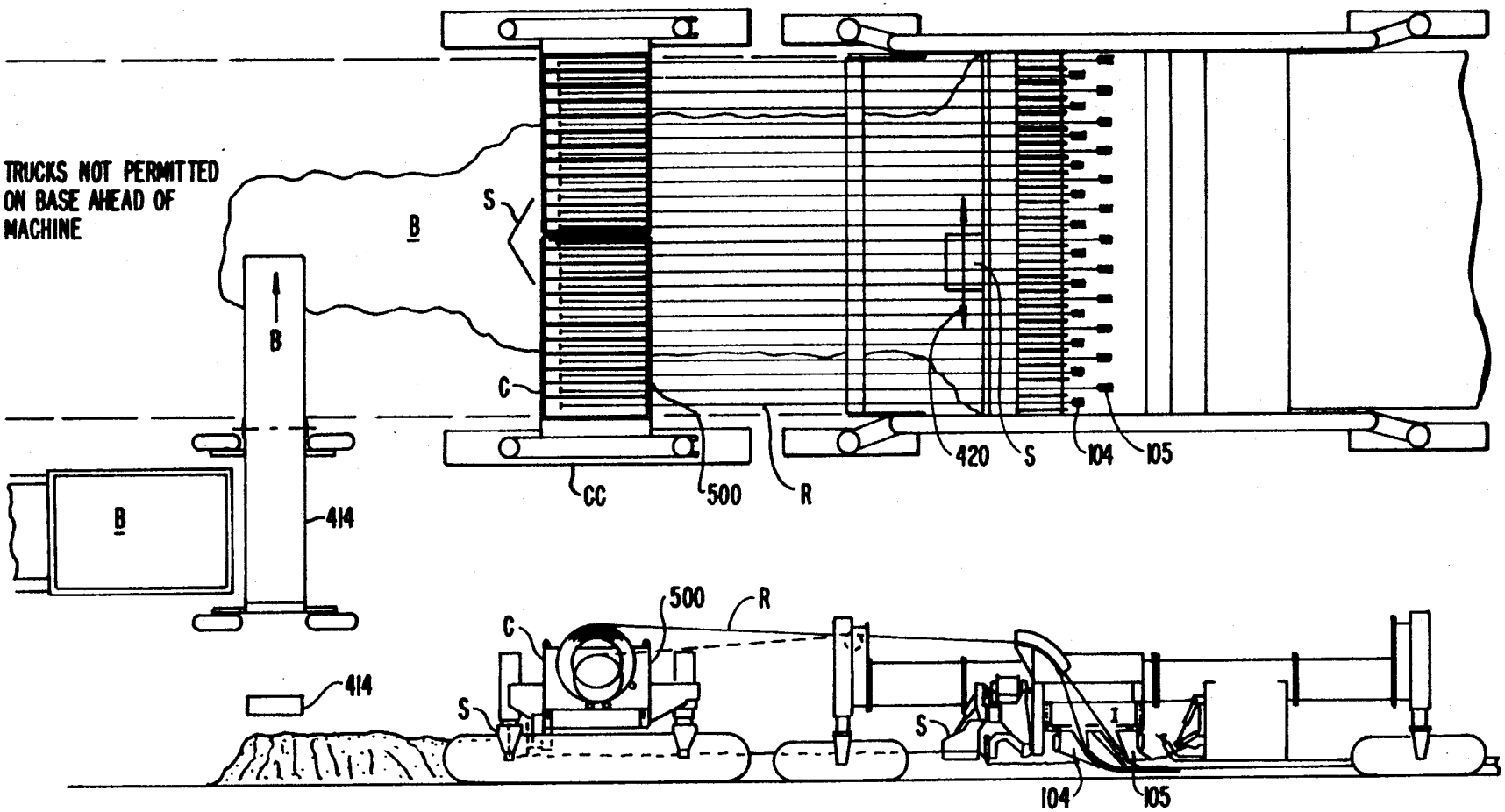
FIG. 6 is a diagram of the inserters of this invention being utilized with concrete side-feed apparatus to enable placement of both concrete and band reinforcement where the direct placement of the concrete on the intended road bed is not possible, practical, or permitted; and, FIG. 7 is a side elevation section of the finally placed concrete illustrating the placement of the reinforcement bands at various elevations to impart improved beam strength to the resultant concrete.

Referring to FIG. 6, a third embodiment is there illustrated. Specifically, a cassette C'' is illustrated supported on self-propelled track mounted cassette carrier. The cassette dispenses the reinforcing band R.

Paver A is illustrated paving over a pavement substrate PB (prohibited for use as a haul road) which substrate PB is unsuitable for passage of dump trucks K. Such a substrate could include roads requiring heavy drainage, bridge surfaces, or the like. In the embodiment here shown in plan view, a dump truck K backs to a side feeder conveyor 414 which discharges on to truck prohibited base PB. At end of conveyer 414, concrete is dumped in the path of the machines. From its position of deposition, a spreading apparatus S moving laterally across the machine along the direction of arrow 420 effects the spreading of the deposited concrete B in the path of the machine. (The machine(s) may consist of machines as in FIG. 1A and 1B without independent cassette carrier ahead or as in FIG. 5 and 6 with cassette carrier.) Thus, it can be seen that the inserters I (see 104, 105, FIG. 6) effect placement of the reinforcing bands R as before. As in the embodiment of FIG. 5, the weight of the cassette C'' is not placed on the road bed. Additionally, the weight of the dump truck K and its deposited concrete B does not pass with its weight on the relatively delicate substrate over which the pavement is placed.

Figure 7:
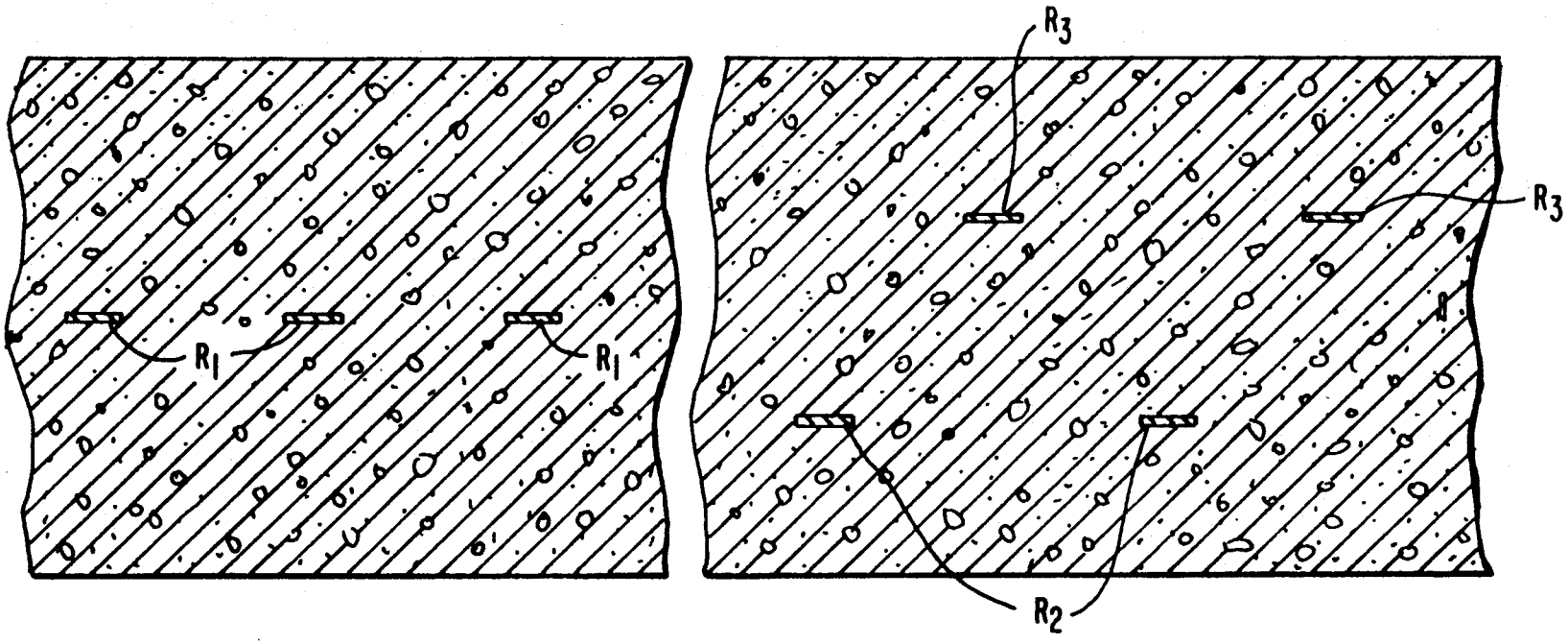

Referring to the FIG. 7, an important advantage of this invention is illustrated. Specifically, the complete slab L is shown in the wake of the machine. The slab L has been sectioned along a vertical plane normal to the direction of passage of the paver A.

As can be seen, reinforcing bands R1, R2 and R3 are illustrated. These specific bands will be seen to be deposited at different elevations in the slab. Because of this characteristic, the paver of this invention has two features not specifically shown in the prior art.

First, it will be noticed that the respective bands are disposed at different elevations. Because they are disposed at different elevations, the bands do not have the tendency to laminate deposited slab L. That is to say that, if the bands were all placed at the same elevation (say on the neutral axis of the slab), the placed slab would have a tendency to split.

Secondly, the respective section of the inserters illustrated in FIGS. 2C, 2G has a beneficial effect. Specifically, by placing the inserters at varying elevations of band discharge, the reinforcing bands R1–R3 can be deposited within the slab at highly predictable elevations with respect to the slab surfaces. Thus, the respective bands R1–R3 can be utilized to impart beam strength to the slab.

This is an important distinction over the prior art. Specifically, in the prior art, concrete has been dumped over and around the previously disposed bands. With such an arrangement, predictable placement of the side-by-side bands at varying elevations has not been possible. It is a property of the disclosed inserters that the bands may be deposited in the wake of the inserters at precisely controlled elevations. Hence, the present invention produces a slab L superior to that set forth in the prior art.

What is claimed is:

1. In combination with a paver controlled to line and grade for laying hardenable concrete pavement along a pavement path, said paver having:

at least one frame;

a supported leveling and confining form attached to said frame;

means for moving said frame over the pavement path of an intended strip of concrete pavement;

means for receiving and spreading said concrete and imparting to said concrete an approximate uniform consumable head;

means for consolidating of said concrete to yield the final specification and dimension of said intended strip of concrete pavement; and means for dispensing a plurality of side-by-side horizontally disposed reinforcing bands in the pavement placed by said paver between the means for spreading and means for consolidating, the improvements to said dispensing means comprising:

a plurality of side-by-side inserters, each inserter for dispensing at least one of said side-by-side horizontally disposed reinforcing bands, said inserters mounted from said frame at the upper end and depending from said frame at the lower end to extend into and pass through freshly placed concrete, said inserters having a shape at the lower end for permitting said inserters to pass through unconsolidated or fluidized concrete; and, means for threading said horizontally disposed reinforcing bands through said inserters from an entrance to said inserters above said concrete to an exit from said inserters within said concrete and means for supporting and accurately dispensing said bands into said concrete slab in the path of said inserters adjacent to front of pavers means for consolidating said concrete.

2. The invention of claim 1 and wherein said means for consolidating said concrete includes vibrating means.

3. The invention of claim 2 and wherein said vibrating means vibrates said concrete in advance of said form.

4. The invention of claim 2 and wherein said vibrating means vibrates said inserters.

5. The invention of claim 2 and wherein said vibrating means vibrates said concrete in advance of said form and said inserters.

6. The invention of claim 1 and wherein said inserters extend in side-by-side relation across the pavement of said paver, each said inserter being staggered with respect to adjacent inserters for increasing clearance and permitting passage of unconsolidated concrete around said inserters and between said horizontally placed bands.

7. The invention of claim 1 and wherein at least two of said side-by-side inserters are suspended from said frame at differing elevations with respect to the placed slab of said pavement.

8. The invention of claim 1 and said dispensing means includes:

a plurality of cassettes for dispensing said horizontally disposed reinforcing bands, said cassettes mounted to said frame and conveying said bands of horizontal reinforcement directly to and through said inserters.

9. The invention of claim 1 and wherein said metering device includes means for spreading concrete attached to said frame, said spreading means being disposed in front of said metering means.

10. The invention of claim 1 and wherein said dispensing means includes:

a self-propelled track or wheel mounted cassette unit mounted independently of said frame for movement with said frame, said cassette unit for continuously dispensing said band reinforcing; and means for fair leading said horizontally disposed band reinforcing to said inserters for placement in the concrete.

11. The invention of claim 10 and wherein said fair leading from said cassette unit occurs over said metering means into said inserters.

12. A paver controlled to line and grade for laying hardenable concrete pavement along a pavement path, said paver comprising:

at least one frame;

means for moving said frame over the pavement path of an intended strip of pavement;

a metering device mounted to said frame for receiving said concrete and imparting to said concrete an approximate uniform head;

means for dispensing a plurality of side-by-side horizontally disposed reinforcing bands mounted to said frame including:

a plurality of side-by-side inserters, each inserter for dispensing horizontally disposed reinforcing bands at the lower end, said inserters mounted to said frame at the upper end and disposed for receiving said horizontally disposed reinforcing bands and defining a path for said bands through said inserters to the lower end of said inserter, said inserters configured at the lower end for passing through unconsolidated concrete;

tube means formed within said inserter for dispensing said bands in the wake of said inserters at specific locations within said concrete slab of said pavement;

means for consolidating said concrete including a pan mounted to said frame for passing over said slab behind said inserters for imparting to said slab at least rough finish to the final dimension of said pavement.

13. The invention of claim 12 and wherein said means for consolidating said concrete includes vibrating means.

14. The invention of claim 13 and wherein said vibrating means vibrates said concrete in advance of said pan.

15. The invention of claim 13 and wherein said vibrating means vibrates said inserters.

16. The invention of claim 13 and wherein said vibrating means vibrates said concrete in advance of said pan and said inserters.

17. The invention of claim 9 wherein said inserters as extending side-by-side across said paver and within said leveled slab are disposed at alternate lengthwise positions longitudinally in the direction of movement of said paver.

18. The invention of claim 9 and wherein at least two of said side-by-side inserters are suspended at differing elevations for releasing said bands at differing elevations.

19. In combination with a paver for laying hardenable concrete pavement along the pavement path:

means for dispensing a plurality of side-by-side horizontally disposed reinforcing bands;

means for moving said dispensing means along a path in front of a paver;

at least one paver frame;

means for moving said paver frame over the pavement path of an intended strip of concrete pavement for depositing said pavement in the path of said paver;

a metering device mounted to the frame of said paver for receiving said concrete and imparting to said concrete an approximate uniform consumable head;

a plurality of side-by-side inserters for dispensing said side-by-side horizontally disposed reinforcing bands, said inserters mounted from said frame and depending from said frame and extending into the concrete pavement slab behind said metering device, said inserters formed to pass through liquified concrete;

means for imparting sufficient vibration to said vibrating inserters at the bottom portion thereof for liquifying concrete to a degree to permit inserters passage; and means for threading said horizontal reinforcing bands from said means for dispensing through said inserters for permitting said inserters to deposit said bands behind said inserters as said inserters pass through said liquified concrete.

20. The invention of claim 12 and wherein said bands are led to said inserters over said metering device;

said vibrating inserters defining a threaded path for said continuous band, said path commencing in said inserters above said slab and passing out of said inserters within said slab.

21. A process for placement of band-reinforced hardenable concrete pavement comprising:

providing at least one frame;

moving said provided frame over the pavement path of an intended strip of concrete pavement;

attaching a metering gate from said frame, said metering gate disposed to receive concrete and impart to said concrete the rough thickness of said concrete pavement with respect to said pavement path as said frame moves over said path;

providing a form mounted to said frame for passing over said slab after said metering gate for imparting to said slab at least the rough finish to the final dimension of said concrete pavement as said frame moves over said pavement path;

providing a plurality of side-by-side inserters, each inserter for dispensing one of said side-by-side horizontally disposed reinforcing bands, said provided inserters mounted from said frame at the upper end and depending from said frame at the lower end to extend into and pass through concrete with the movement of said frame, said provided inserters having a shape at the lower end for permitting said inserters to pass through fluidized concrete and defining a path interior thereof for permitting horizontally disposed reinforcing bands to pass from above the surface of placed concrete to a position below the surface of placed concrete; and, threading and dispensing said horizontally disposed reinforcing bands through said inserters for placing said bands in said concrete slab in the path of said inserters.

22. The process of claim 21 and including the step of staggering said inserters with respect to adjacent inserters for permitting aggregate in said concrete to pass around said inserters and between said horizontally placed bands.

23. The invention of claim 21 and including the step of attaching said side-by-side inserters to said frame at differing elevations with respect to said slab of pavement.

24. The invention of claim 21 and including the step of:

providing a cassette unit mounted independently of said frame for movement with said frame, said cassette unit for continuously dispensing said horizontally disposed band reinforcing; and, leading said horizontally disposed band reinforcing from said cassette through said inserters for placement in said concrete.

25. The invention of claim 24 and wherein said leading step includes leading said bands from said cassette over said metering gate and into said vibrating inserters.

26. The invention of claim 21 and including the step of vibrating said concrete.

27. The invention of claim 26 and wherein said vibrating step includes vibrating said inserters.

28. The invention of claim 26 and wherein said vibrating step includes vibrating said concrete in advance of said pan.

* * * * *